United States Patent [19]

Allen

[11] 4,101,325

[45] Jul. 18, 1978

[54] CONDUIT AND METHOD FOR PROCESSING WEBS WITH A LIQUID SOLUTION

[75] Inventor: Robert F. Allen, Rochester, N.Y.

[73] Assignee: Eastman Kodak Company, Rochester, N.Y.

[21] Appl. No.: 677,633

[22] Filed: Apr. 16, 1976

Related U.S. Application Data

[60] Division of Ser. No. 490,155, Jul. 19, 1974, Pat. No. 3,968,510, which is a continuation of Ser. No. 375,576, Jul. 2, 1973, abandoned.

[51] Int. Cl.[2] ..... G03C 5/24; G03C 5/26

[52] U.S. Cl. ..... 96/48 R; 96/50 R; 96/63

[58] Field of Search ..... 96/50, 48 R, 63, 4, 96/39, 78; 134/14, 64 P

[56] References Cited

U.S. PATENT DOCUMENTS

| | | | |
|---|---|---|---|
| 1,362,146 | 11/1919 | San | 134/14 |
| 1,441,163 | 1/1923 | Martin et al. | 134/64 P |
| 1,499,099 | 6/1924 | Ybarrondo | 96/63 |
| 1,664,735 | 4/1928 | Capstaff | 134/64 P |
| 2,317,591 | 4/1943 | Cramwinckel et al. | 96/63 |
| 2,920,960 | 1/1960 | Bushell | 96/63 |
| 3,575,100 | 4/1971 | Krause | 134/64 P |
| 3,662,665 | 5/1972 | Meeussen et al. | 134/64 P |
| 3,705,544 | 12/1972 | Ratowsky | 96/48 R |
| 3,977,876 | 8/1976 | Ratowsky | 96/48 R |

*Primary Examiner*—Mary F. Kelley
*Attorney, Agent, or Firm*—S. W. Gremban

[57] ABSTRACT

An enclosed conduit such as a tube, and a method for processing webs with a liquid solution, wherein the web is positioned helically around the periphery of the tube. The tube has openings, such as being porous, at least in the helical path of the web. A liquid solution cushion or bearing is formed between the web and periphery of the tube in at least the helical path of the web by continuously directing the liquid solution outwardly through the openings. In one embodiment, the web is transported by drive rollers or belts against which the web is forced, and edge deflected between the convolutions of a helical rail or band wrapped around the periphery of the tube. In another embodiment, the tube is provided with axially spaced, radially extending protuberances on its periphery for edge deflecting the web along a helical path.

5 Claims, 14 Drawing Figures

CONDUIT AND METHOD FOR PROCESSING WEBS WITH A LIQUID SOLUTION

This is a division of application Ser. No. 490,155 filed July 19, 1974, now U.S. Pat. No. 3,968,510 continuation of Application Ser. No. 375,576, filed July 2, 1973.

BACKGROUND OF THE INVENTION

1. Field of the Invention

This invention relates generally to an apparatus and a method for processing webs, and more specifically to an enclosed conduit, such as a tube, and a method for processing a continuous web or webs of varying length with a liquid solution.

2. Description of the Prior Art

U.S. Pat. No. 3,186,326 discloses a photographic film processing device having a plurality of tanks, each containing a different film processing solution, such as a developing solution, a stop solution, a fix solution, and a wash solution. In each tank, liquid bearings are provided at the top and bottom thereof immersed in the film processing solution. The film strip to be processed is guided over these bearings in a generally sinuous path forming one or more loops in each tank in which the major length of film is unsupported. U.S. Pat. No. 3,662,665 discloses a drum processing device having a peripheral, helical channel for guiding a film through successive solution baths. The film, however, is not supported on a liquid or solution bearing. U.S. Pat. No. 3,481,046 discloses a drum drying device in which a web is helically wrapped around a perforated drum through which air is directed for supporting the web on an air cushion while drying the web. One disadvantage of the prior art solution processing devices is that considerable force is required to transport the web through the processing device. Another disadvantage of such prior art devices is that the solution agitation achieved thereby, and which is of great importance in a photographic processing device, is not always uniform or consistent for the entire film area at any transport speed, and is normally at a low level of agitation. In the U.S. Pat. No. 3,186,326, the agitation is greater directly over the solution film bearing surface where the solution is forced against the film and less at the unsupported film-solution surface between the bearings. Accordingly, high agitation is achieved only part of the time, and is not consistent for the entire film area. In U.S. Pat. No. 3,662,665, the agitation is of a low level resulting from passage of the film through the solution baths and is virtually nonexistent in the remainder of the film path outside of the solution baths. U.S. Pat. No. 3,481,046 relates to a web dryer in which jets of drying air are used, and hence does not contemplate web processing by liquid solutions. Due to the spacing of the openings, if a liquid solution were used, the agitation resulting from the spaced jets of solution would undoubtedly be non-uniform, being greatest where the jet strikes the web, and least on the web surface between the jet impact points.

There is a need in the prior art for the constant and continuous displacement of a liquid solution is engagement with the film with substantially fresh or active liquid solution along the entire length of the solution engaged film surface. Such continuous liquid solution displacement provides uniform and consistent high solution agitation and uniform reproducible processing results at low as well as high film transport speeds.

There is a further need in the prior art for a photographic processing apparatus in which no moving parts are provided in the processing section other than liquid solution recirculating pumps.

SUMMARY OF THE INVENTION

Briefly, the invention is an apparatus for processing webs comprising an enclosed conduit, such as a chamber or a tube, for positioning or supporting a web on the outer surface of the tube. Means are provided, manual or mechanical, for directing or guiding the web helically around the periphery of the tube. The tube has closely spaced openings, preferably in the micron range such as achieved by a porous tube through which a liquid processing solution can reach the outer surface of the conduit, for instance, from the interior of the conduit. The openings are at least in the helical path of the web, whereby a liquid cushion or bearing is formed between the web and outer surface of the tube at least on the helical path around the periphery of the tube. The liquid cushion is formed by means for continuously directing, for example by forcing, the liquid processing solution outwardly through the openings to the outer surface of the conduit.

The invention is also a method for processing a web with a liquid processing solution between the outer surface of an enclosed conduit, such as a chamber or a tube, and the web. The web is helically directed or guided, for example by transporting, around the periphery of the conduit having closely spaced openings in at least the helical path of the web. A liquid processing cushion or bearing is formed between the web and the outer surface of the conduit at least on the helical path of the web around the periphery of the conduit by continuously directing, for example by forcing, the liquid processing solution through the openings outwardly to the outer surface of the tube.

The openings of the conduit are preferably pores, but can be any suitable openings such as perforations, slots, or channels which are substantially equivalent to pores in the number of openings per surface area. Exemplary of the liquid processing solutions are developing solution, stop bath solution, fixing bath solution or washing solution for processing photographic films or webs.

In accordance with a preferred embodiment of the apparatus of this invention, a stationary liquid solution-transmitting tube is provided. Means are provided for forcing a liquid processing solution substantially radially outwardly, through the tube at a predetermined rate in liters per minute for forming a substantially uniform liquid-solution cushion or bearing for supporting thereon the entire length of a web encircling or wrapped on the tube along a helical path. The web is transported by a minimal amount of force along the helical path on the liquid solution bearing for processing.

In a further embodiment of the invention, film deflecting means are provided on the tube periphery for deflecting and assuring transport of the web along the helical path. Means are provided for helically transporting short lengths of web around the tube while supported by the liquid solution bearing for processing the web. The web transporting means in one embodiment comprises one or more drive rollers or belts adjacent the tube and engageable by a helical web convolution on the tube. In another embodiment, the tube is hollow and porous, and has a helical deflector rail of T-shaped cross section encircling the tube. In another embodiment, the tube has a plurality of axially spaced, radially extending deflector protuberances on the periphery thereof. In still another embodiment, the tube has a helical deflector band of a C-shaped cross section encircling the tube and supported on radially extending deflector protuberances. In further embodiments of the invention, a plurality of porous processing tubes are provided in succession, and the tubes are arranged either in parallel relation with canted cross-over pulleys, or in non-parallel relation to accommodate web twist or helix and permit web transport over the tubes along a substantially straight path. In still another embodiment the tube processing device comprises one or more modular processing units.

One of the primary advantages of this invention is the improved uniform and consistent application of a liquid processing solution to an entire web surface with a high rate of agitation at low as well as high web transport speeds. In this invention a flow of uniform substantially fresh or active processing solution is constantly applied in the form of jets through closely spaced openings, preferably only thousandths of an inch apart, to every incremental part of the web surface. Such solution flow results in continuous displacement of solution in engagement with the web surface and partially exhausted by the processing action at the web surface. In addition, an exceptional uniformity of high agitation and hence uniform reproducible processing results are achieved with all areas of the web receiving substantially the same degree of agitation and processing. Another advantage of this invention is the reduced or minimal force required to transport the web through the processing device. Still another advantage is that in at least one embodiment, any length of web can be processed without the necessity of initially threading the web through the processing device. Another advantage is that the processing device can be modular, and requires few parts and hence is economical. Another advantage is that no moving parts are provided in the processing section other than liquid solution recirculating pumps.

It is, accordingly, one of the objects and advantages of the present invention to provide an improved apparatus and method for processing webs in which the liquid processing solution is constantly renewed to every incremental area of the web surface.

Another object and advantage of the invention is to provide an improved apparatus and method for processing webs in which there is constant and continuous displacement of solution in momentary engagement with the web surface.

Another object and advantage of the invention is to provide an improved method and apparatus comprising a porous enclosed conduit for processing a web with a liquid solution, in which all areas of the web surface are subjected to uniform high solution agitation resulting in uniform reproducible processing results at low as well as high web transport speeds.

Another object and advantage of the invention is to provide an improved apparatus and method for processing webs which is of simple design and construction, thoroughly reliable and efficient in operation, and economical to manufacture.

The invention and its objects and advantages will become more apparent from the detailed description of the preferred embodiments presented below.

BRIEF DESCRIPTION OF THE DRAWINGS

In the detailed description of the preferred embodiments of the invention presented below, reference is made to the accompanying drawings, in which.

THE PREFERRED EMBODIMENTS OF THE APPARATUS

Because web processing devices are well known, the present description will be directed in particular to elements forming part of, or cooperating more directly with, apparatus in accordance with the present invention. Elements of the processing apparatus not specifically shown or described herein should be understood to be selectable from those known in the art.

Figure 1:
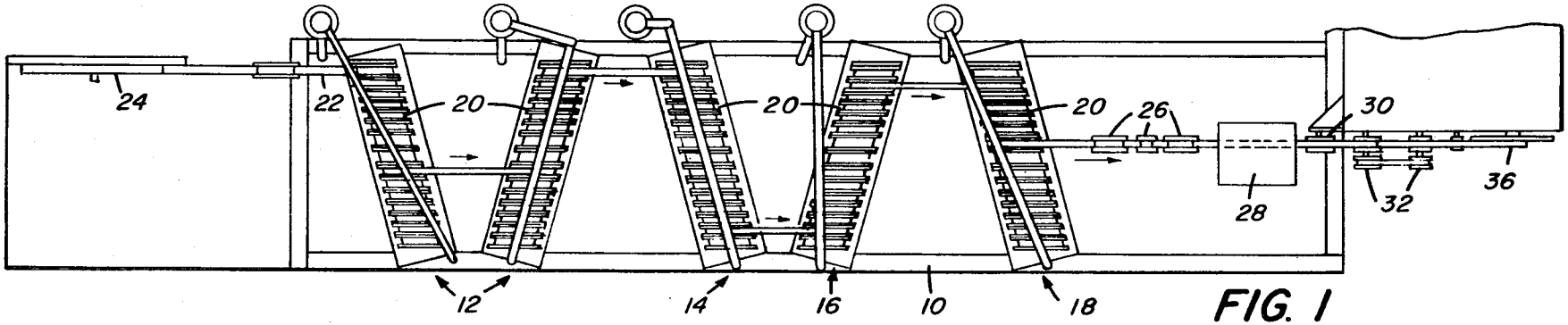
FIG. 1 is a top plan view illustrating a preferred embodiment of the tube processing apparatus of this invention.
Figure 2:
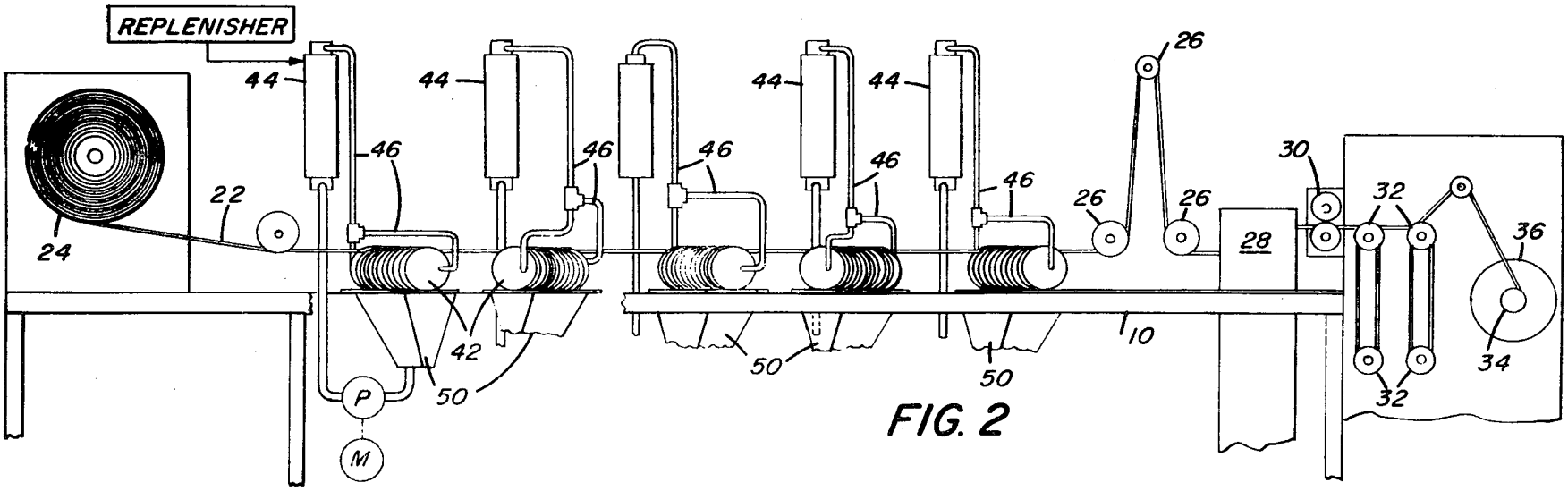
FIG. 2 is a side elevational view of the processing apparatus of FIG. 1.
Figure 3:
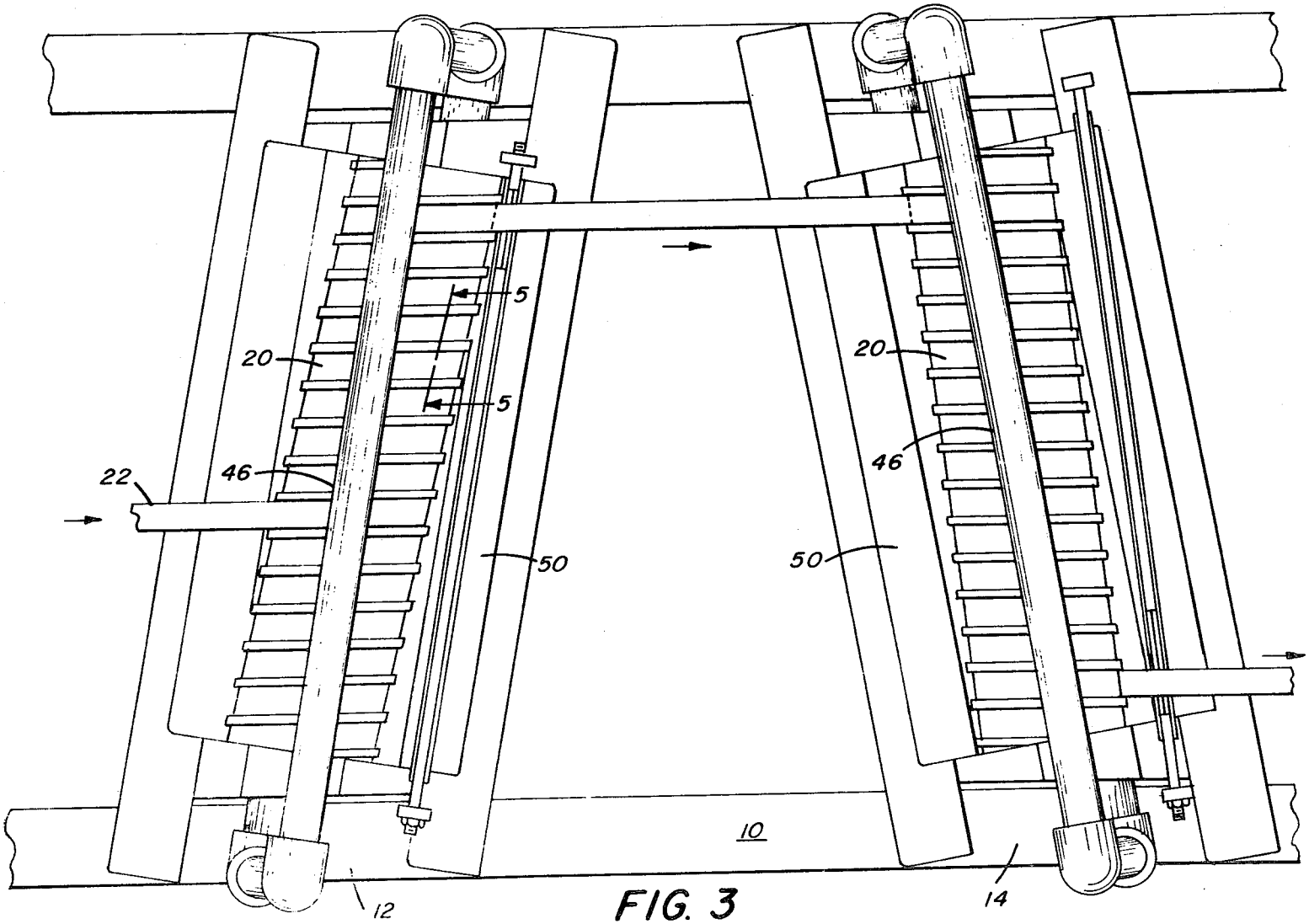
FIG. 3 is an enlarged top plan view of a portion of the processing apparatus of FIG. 1.

With reference to FIGS. 1–3 of the drawings, the tube liquid solution processing apparatus of this invention is disclosed mounted on a support frame 10 formed from a plurality of angle irons and braces. The web processing apparatus comprises a plurality of processing stations such as one or more developing stations 12, a wash station 14, a fixing station 16, and a wash station 18, or any other suitable combination of such stations, as well as other stations, if desired, such as bleaching and stabilizing stations. Stationary web support tubes 20 are provided at each of these stations, and a leader connected to a continuous web or film 22 from a film supply, such as a supply reel 24, is threaded along a helical path around tubes 20 at the processing stations in succession, around inverting rollers 26, through a drier 28, through transport rollers 36, around elevator rollers 32 and onto a take-up reel 34. After the film leader has been threaded, operation of transport rollers 36 driven by any suitable drive motor, not shown, transports the film through the processing apparatus and drier onto take-up reel 34.

Figure 4:
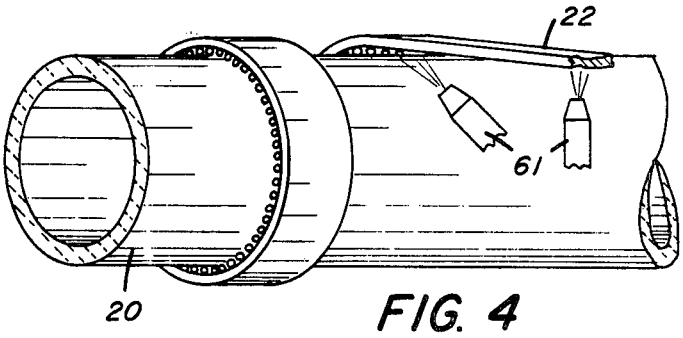
FIG. 4 is a segmental view of a porous tube suuporting a web on a solution cushion.
Figure 5:
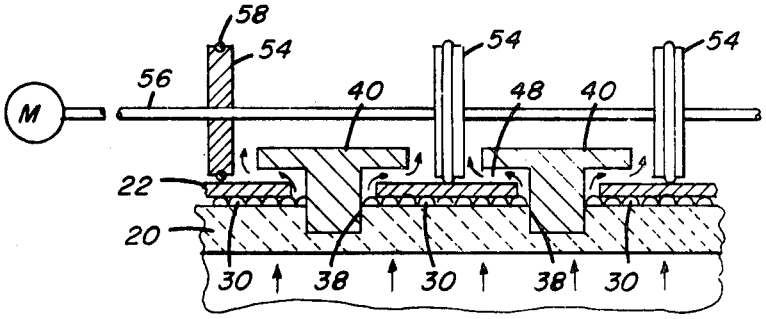
FIG. 5 is a segmental section view taken substantially along line 5—5 of FIG. 3, and further incorporating a web transport means.

With reference to FIG. 4, a stationary processing tube 20 of the type utilized in this invention is illustrated in which the tube is hollow and preferably porous, and formed of any suitable material by any suitable operation, such as molding or sintering. The porous tubes can be of any suitable porosity measured in microns (porosities of 20 to 200 microns have been used successfully), and the processing solution can be forced radially through the shell of the tube by any suitable pressure means, such as a pump. The solution forms a liquid solution cushion or bearing on the tube periphery for supporting a film helically wrapped around the tube. The height of the liquid bearing in operation has varied from 0.001 inch to 0.008 inch at web tensions varying between 30 to 400 grams. Flow rates used have varied between 20–40 liters per minute. In the tube illustrated in FIG. 5, the outer periphery of tube 20 is provided with a helical groove 38, and a deflector rail 40 of substantially T-shaped cross section is mounted in the groove and secured thereto by any suitable means. Although the film, following threading, normally assumes a helical path, the deflector rail 40 assures that such path will be followed and prevents the film from straying. The deflector rail 40 is preferably formed from extruded stock material, and serves to deflect the film in those situations in which the upper and edge surfaces of the film engage the rail. When installed in a processing device as illustrated in FIGS. 1–3, any resistive element, not shown, can be mounted within the hollow tube and provided with lead wires extending through one or both of any suitable end caps 42 (FIG. 2) secured to the ends of tube 20 for heating the processing solution. If desired, an external heat exchanger of known type can be used to heat the processing solution. Any suitable sealing means, not shown, is interposed between end cap 42 and tube 20 to prevent leakage of solution therebetween, and any suitable means, such as a tank 44 of processing solution, tubing 46, and a motor-driven pump "P" is provided for pumping the solution under pressure through one or both of the end caps 42 of each tube 20 into the interior thereof. The solution in tube 20 is forced substantially radially outwardly through the outer shell of the tube, as best seen in FIGS. 4 and 5, forming a cushion or solution bearing 30 in a helcial channel 48 formed between convolutions of the helical film guide rail 40. If a film is threaded through channel 48, the solution bearing 30 engages the inner or emulsion surface of film 22 for supporting the film out of engagement with tube 20. In one application utilizing a liquid solution flow of 35 liters per minute through an 18 inch long porous tube having a 3 inch diameter, and subjecting the film to a tension of substantially 20 grams, a solution bearing 30 was formed having a thickness of substantially .006 inches. Since the liquid solution is continually being forced through the closely spaced pores in porous tube 20, new solution is continually being forced into engagement with the emulsion surface of the film, then past the outer edges of the film, then along the back surface of the film, and into a drain tank 50 (FIG. 2) supported below tube 20 on frame 10. Such continuous solution flow in the form of closely spaced jets of solution into engagement with and along the emulsion surface provides a high rate of uniform solution agitation whether the film transport is slow or fast, and further provides a solution cushion generally ranging between 0.001 inch to 0.008 inch substantially encircling the film convolutions for maintaining the film normally out of engagement with deflector rail 40. The partially exhausted solution from each of the tanks 50 is normally fed by gravity through any suitable tubing to the inlet of pump "P" for recirculation through tube 20 with replenishment provided by any suitable replenishment system to replace lost solution and maintain the solution active or substantially fresh. If desired, batch processing can be utilized in which the processing solution is pumped through a continuous system or path for each station, until the strength of the solution is depleted to a predetermined level. When this occurs, the exhausted solution is drained and fresh solution is introduced into tank 44. It is also possible, of course, to provide a continuous single usage system in which fresh or active solution from any suitable source is constantly pumped through each tube 20, and the partially exhausted solution from each tank fed directly into an exhaust sump or drain.

Figure 7:
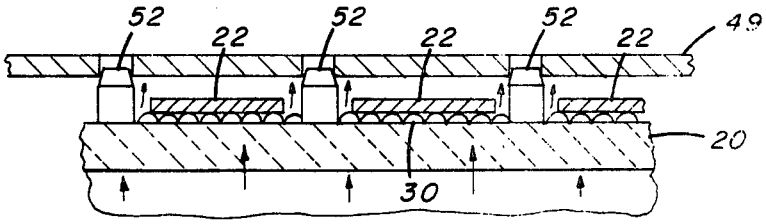
FIG. 7 is a section view taken substantially along line 7—7 of FIG. 6, illustrating a web supported on a solution cushion.
Figure 6:
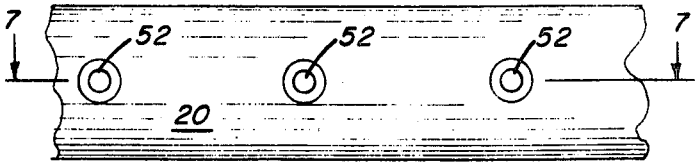
FIG. 6 is a segmental top plan view of another embodiment of the tube of this invention.
Figure 8:
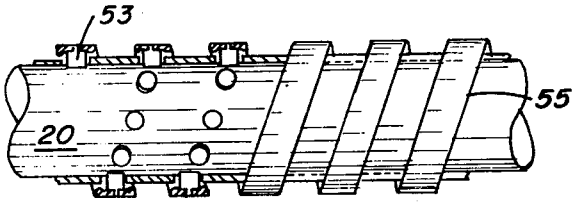
FIG. 8 is a view similar to FIG. 6 illustrating a processing tube having a plurality of deflector pins in its periphery for supporting a substantially C-shaped band.
Figure 9:
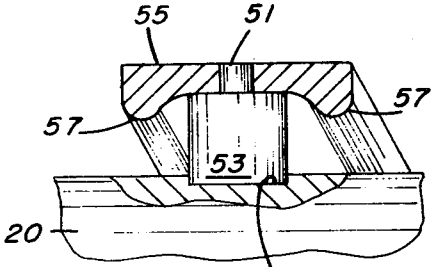
FIG. 9 is a segmental enlarged view partially in section of one of the deflector pins and band of FIG. 8.

In the modification of the invention illustrated in FIGS. 6–8, tube 20 is provided with a plurality of axially spaced, radially extending deflecting protuberances, such as pins 52 embedded into and secured to tube 20 by any suitable means. The pins 52 have a tapered head to facilitate threading of the film therebetween, and each head is larger in diameter than a film perforation to prevent the film perforations from catching on the pins. During threading of the device, the film 22 is helically wound on tube 20 through spaced deflector pins 52. When a continuous film is being processed and a threading leader used, only one row of pins 52 as illustrated in FIGS. 6 and 7 is required to properly deflect the film along a helical path. If desired, a hold-down plate 49 can be mounted on the tapered ends of pins 52 to deflect the film downwardly and to prevent inadvertent movement of a film loop over one of the pins 52. However, where discrete lengths of film are processed, a plurality of rows of similar pins 53 are required as illustrated in FIGS. 8 and 9 over which a helical band 55 is clamped by virtue of its inherent resilience. The band 55 can be provided with indentations for receiving the heads 51 of pins 53, and further has curved surfaces 57 to provide an outer deflector for deflecting the film by point or line contact around tube 20, thereby minimizing friction. The bases of end pins 53 are secured to tube 20, and the bases of the remaining pins can be secured to tube 20 or inserted in recesses 59 in which they are held by the resiliency of band 55. If desired, any suitable air jet guide or squeegee 61 as shown in FIG. 4 or any other suitable carry over roller or the like can be interposed between tanks 50 to direct or guide film 22 from one to the other and to prevent carry-over of solution from one tank 50 to the next succeeding tank. Normally, the carry over is so slight that squeegees for this purpose alone are not necessary.

For discrete lengths of film, a leader and apparatus for splicing two lengths together can be dispensed with and the processing device made self-threading by feeding film strips of discrete length directly into the space provided between the rail and each tube 20 as best seen in FIG. 5. The film is transported by a plurality of transport rollers 54 mounted on shafts 56 and arranged with tires 58 mounted on the periphery thereof spaced from tube 20. If desired, endless transport belts, not shown, can be used instead of rollers 54 in which the belt is trained over a pair of rollers with a reach of the belt in engagement with web 22. During processing operation, solution bearing 30 forces the outer surface of web 22 into driving engagement with the belts or tires 58. The shafts 56 are rotatably driven by any suitable drive motor. In such a system, guides of any suitable type such as tracks, corss-over devices or air jet guides 61 illustrated in FIG. 4 are provided for guiding the film from one tube 20 at a processing station to the next tube at the succeeding processing station.

Figure 13:
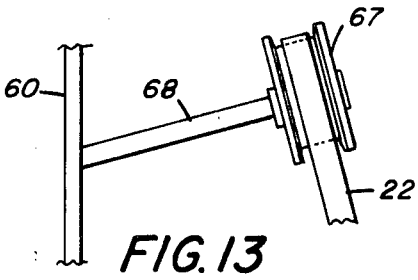
FIG. 13 is an enlarged view of the cross-over roller of FIG. 12.

When a film is transported to a cylindrical member at right angles to the axis thereof, and then helically wound around the member, a twist is imparted to the film so that all portions of the film surface are not in engagement with and parallel to the periphery of the member. Accordingly, if tubes 20 are positioned with their axes at right angles to a vertical plane passing through the ends of the tubes, the inner or emulsion surface of each helical film convolution will be non-parallel or radially spaced different distances from the tube periphery from one edge of the film to the other. Such non-parallel positioning of the film may have an adverse effect on processing uniformity. This problem can be eliminated by providing a canted cross-over pulley 67 (FIG. 13) between the parallel tubes for directing the film at the desired angle to each tube. This problem can also be eliminated in the processing device by positioning or arranging tubes 20 in the horizontal plane in a canted or non-parallel relation, as illustrated in FIGS. 1 through 3, to compensate for the twisting. The angle that each of the tubes 20 is tilted or canted in the horizontal plane relative to the aforementioned vertical plane is substantially equal to the web helix angle. Consequently, the film emulsion surface is substantially parallel to the periphery of the tube, as seen in FIG. 3.

Since the entire length of the film wrapped around or encircling tube 20 is supported on a solution bearing 30, and substantially entirely encircled by solution, the friction between film 22 and tube 20 is of a low or negligible value. Accordingly, transport of the film through the processing device can be achieved by subjecting the film to values of tension as low as 20 grams by any suitable film engaging pressure rollers or the like at the exit end of the device. Preferably, a plurality of transport belts or rollers 54 are provided adjacent each of the tubes 20 for transporting the film through the device, as explained heretofore.

Figure 10:
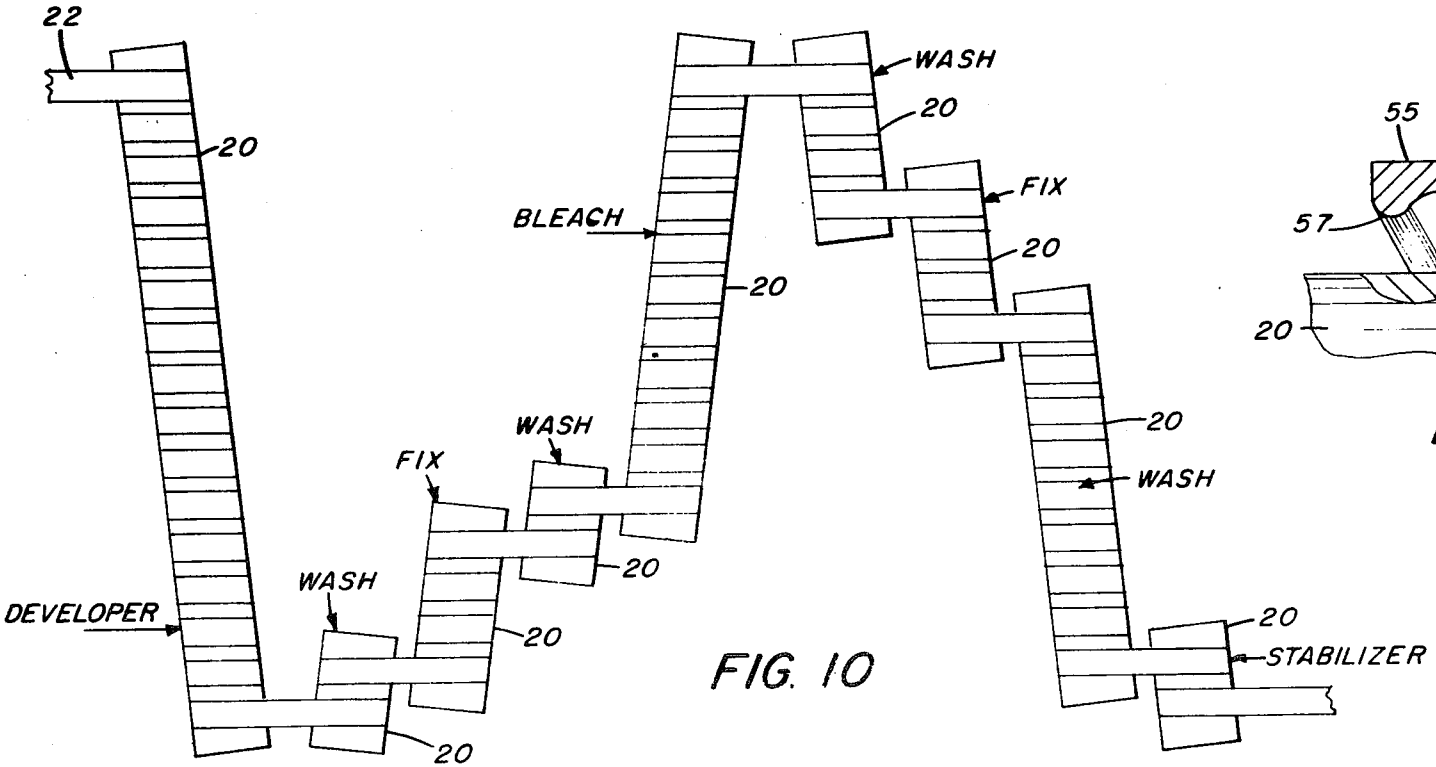
FIG. 10 is a schematic top plan view illustrating a processing apparatus having tubes of varying length for the various processing stations.

As illustrated in FIG. 10, the processing device can be readily designed by properly selecting the lengths of the tubes to subject the film to substantially the exact processing time required for each processing operation. Knowing the tube diameter and film transport speed, the number of film wraps and length of tube can be readily calculated to obtain the required processing time. For example, if the tube diameter and film speed are selected so that it would take 30 seconds for the film to make one wrap around the tube, and the development time required for a specific type of film is 7½ minutes, a developer tube of sufficient length to accommodate 15 wraps is used. If only a 30 second processing time is required for any particular processing operation, the tube 20 is constructed of sufficient length to accommodate only one wrap. If desired, the tubes may be made longer at each station, but only the desired number of wraps around the tube utilized for the particular processing operation.

Figure 11:
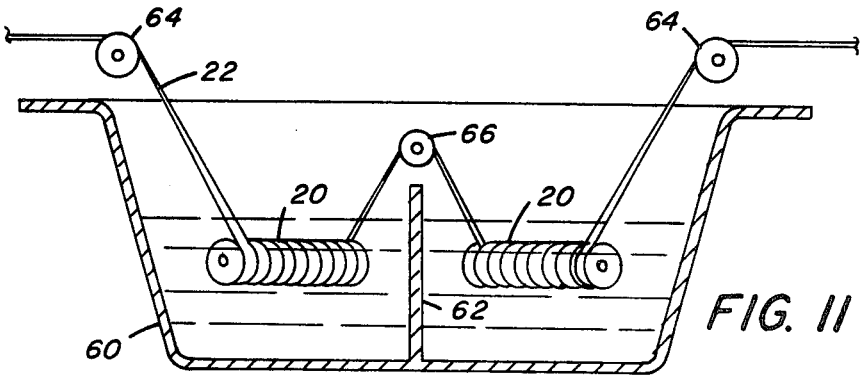
FIG. 11 is a side elevational view partially in section illustrating a modification of the invention in which the tubes are canted and totally immersed in solution.
Figure 12:
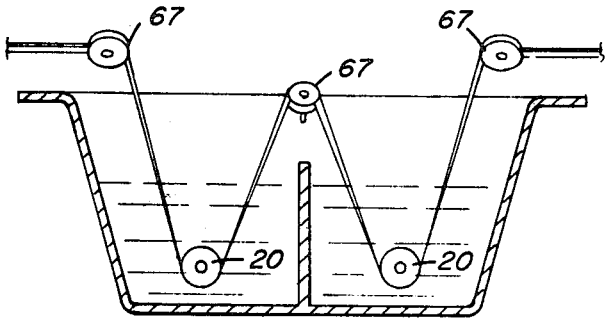
FIG. 12 is a side elevational view similar to FIG. 11 in which the tubes are parallel and a canted cross-over roller is used.

If oxidation of the processing solution by exposure to atmosphere becomes a problem, the processing tubes 20 can be immersed in the processing solution as illustrated in FIGS. 11 and 12. In FIG. 11, a processing tank 60 is provided having a partition 62 for dividing the tank into two chambers for receiving two different types of processing solution. The film 22 is guided over a guide roller 64 onto a leading end of a rigidly mounted tilted or canted processing tube 20, and from the trailing end of tube 20 over a crossover guide roller 66 onto the leading end of another tilted processing tube 20. The transfer roller 66 is mounted on a horizontally arranged shaft. A similar system is illustrated in FIG. 12 in which the tubes 20 are rigidly mounted by any suitable means in parallel relation, and canted crossover rollers 67 (FIG. 13) are provided to accommodate the film helix angle and provide a smooth transfer from one tube to the other. Although only two chambers and tubes are illustrated in FIGS. 11 and 12, naturally any desired number may be used for any desired processing operation.

Figure 14:
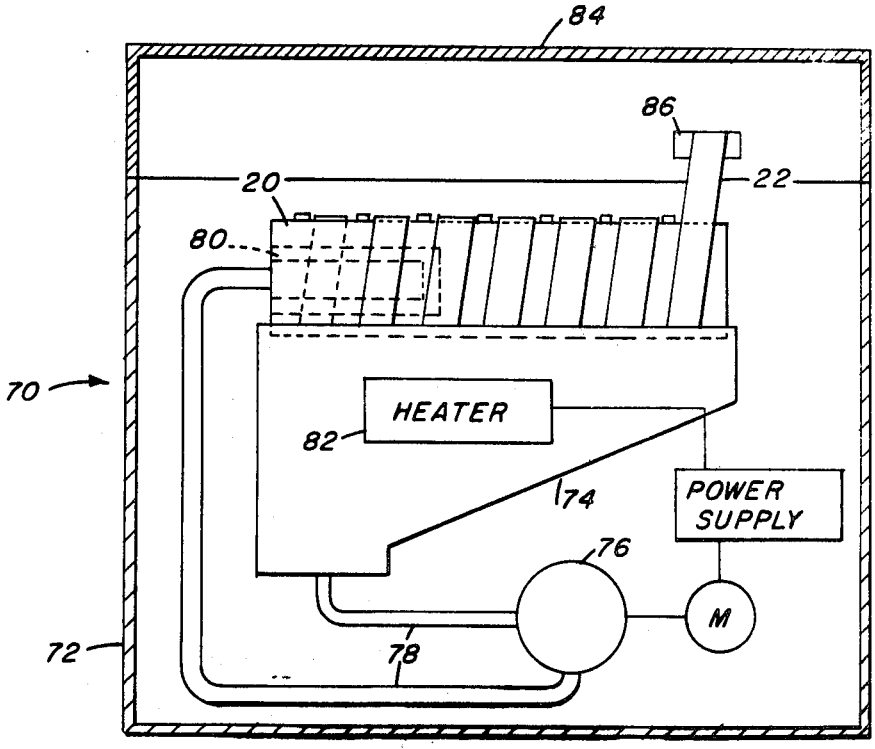
FIG. 14 is a side elevational view partially in section of a processing tube module for use in a modular processing device.

It is also conceivable to adapt the tube processing device of this invention to a modular processing system made up of a desired number of processing modules 70 of the type illustrated in FIG. 14. Processing module 70 comprises a lower housing 72 for supporting, by any suitable means, a processing tube 20 of the type described heretofore, a solution tank 74 and pump 76 driven by any suitable motor M for recirculating the processing solution from tank 74 to tube 20 through conduits 78. A solution filter 80 is mounted within tube 20 for filtering the solution introduced therethrough from tube 78. If desired, filter 80 can be mounted externally of tube 20, for example, in conduit 78 between pump 76 and tube 20. A heater 82 of any suitable type is mounted adjacent or within tank 74 for heating the processing solution to any desired temperature. A power supply is also provided coupled by any suitable means to heater 82 and motor M. The module 70 is provided with a cover 84, and the cover is preferably provided with passage ways 86 through which film 22 is guided onto tube 20 by any suitable transfer guide roller, not shown, of the type illustrated in FIGS. 11–13, or any other suitable type. Such transfer rollers are interposed between each pair of modules 70 to guide the film from one module to the succeeding module.

The invention has been described in detail with particular reference to preferred embodiments thereof, but it will be understood that variations and modifications can be effected within the spirit and scope of the invention as described hereinabove.

I claim:

1. A method for processing an imagewise exposed photographic web with a liquid processing solution supplied through a processing conduit having pores between the inner and outer surfaces of the conduit at least along a helical path; said method comprising the steps of:

flowing processing liquid into the conduit and at least a portion thereof through said pores;

forming an elongate cushion of the liquid processing solution on the outer surface of the conduit at least along said helical path for supporting a section of the web along said helical path and;

guiding a web around said conduit in the helical path with one surface of said web in engagement with said liquid cushion for processing said web.

2. A method for processing a surface of an imagewise exposed photographic web with a liquid processing solution supplied through a conduit having openings extending from the inner surface of the conduit to the outer surface of the conduit at least along a helical path; said method comprising the steps of:

directing a liquid processing solution into said conduit and through said openings to form a continuous cushion of liquid solution on said outer surface along said helical path; and guiding a web helically around said conduit with said surface of said web in engagement with said helical liquid solution cushion for processing said web.

3. The method according to claim 2 comprising the further step of transporting said guided web from a web supply to a web take-up.

4. A method for processing a travelling web with a processing solution, the web having a side including an imagewise exposed photographic layer and the solution flowing through a processing conduit having porous walls between the inner and outer surfaces thereof; the method comprising the steps of:

directing the processing solution through the porous walls of said processing conduit to the outer surface thereof;

forming an uninterrupted bearing of the liquid processing solution on the outer surface of the conduit at least along an elongate path encompassing the periphery of the conduit and;

directing the web around said conduit with said side spaced from said conduit by said liquid bearing and in contact with the processing solution forming said bearing for processing said web.

5. A method for processing an imagewise exposed photographic surface of a travelling web with a liquid processing solution contained within a tubular processing chamber having apertures opening to an outer processing surface, comprising the steps of:

discharging the liquid processing solution through said apertures to said outer processing surface of the tubular processing chamber to form a liquid processing bearing on said outer processing surface at least along a helical path encompassing the periphery thereof and;

disposing the surface of the travelling web adjacent said helical path whereby the web is supported by said liquid bearing and the surface thereof is in engagement with the processing solution for processing said web.

* * * * *